US010011029B2

(12) United States Patent
Bellisario et al.

(10) Patent No.: US 10,011,029 B2
(45) Date of Patent: Jul. 3, 2018

(54) CLIPPER COMB HAVING A HOLDABLE EXTENSION

(71) Applicants: Enrico Bellisario, North Huntingdon, PA (US); Lori Bellisario, North Huntingdon, PA (US)

(72) Inventors: Enrico Bellisario, North Huntingdon, PA (US); Lori Bellisario, North Huntingdon, PA (US)

( * ) Notice: Subject to any disclaimer, the term of this patent is extended or adjusted under 35 U.S.C. 154(b) by 168 days.

(21) Appl. No.: 15/010,355

(22) Filed: Jan. 29, 2016

(65) Prior Publication Data

US 2017/0217031 A1 Aug. 3, 2017

(51) Int. Cl.
*B26B 19/20* (2006.01)
*B26B 19/06* (2006.01)
*B26B 19/38* (2006.01)

(52) U.S. Cl.
CPC ..... *B26B 19/20* (2013.01); *B26B 19/06* (2013.01); *B26B 19/3813* (2013.01); *B26B 19/3893* (2013.01)

(58) Field of Classification Search
CPC .. B26B 19/20; B26B 19/3806; B26B 19/3813
USPC ..... 30/195–202, 233.5; D28/53, 54
See application file for complete search history.

(56) References Cited

U.S. PATENT DOCUMENTS 429,722 A * 6/1890 Hatcher ..... B26B 19/20 30/201
481,977 A * 9/1892 Smith ..... B26B 19/20 30/201
1,615,328 A * 1/1927 Fewins ..... B26B 19/00 30/201
1,649,999 A * 11/1927 Yancey et al. ..... B26B 19/20 30/201
1,753,750 A * 4/1930 McArdle et al. ..... B26B 19/066 30/200
1,764,556 A * 6/1930 Friedman ..... B26B 19/20 30/201
2,029,792 A * 2/1936 Pluchino ..... A45D 24/36 30/200
2,092,153 A * 9/1937 Fewins ..... B26B 19/20 30/201
2,517,999 A * 8/1950 Giorgi ..... B26B 19/20 30/201
2,577,357 A * 12/1951 Pasquesi ..... B26B 19/20 30/201
2,603,865 A * 7/1952 Sneed ..... B26B 19/00 30/233.5

(Continued)

FOREIGN PATENT DOCUMENTS

DE 3420252 A1 * 12/1985 ..... B26B 19/20
DE 3727482 A1 * 3/1989 ..... B26B 19/20

(Continued)

*Primary Examiner* — Jason Daniel Prone
(74) *Attorney, Agent, or Firm* — Ference & Associates LLC

(57) ABSTRACT

One embodiment provides a guide comb having a holdable extension. The guide comb includes a central portion including a plurality of teeth extending at one end thereof and the holdable extension extending from an opposite end with respect to the plurality of teeth. A lower face of the central portion includes an attachment mechanism to reversibly secure a hair clipper. Other aspects are described and claimed.

18 Claims, 4 Drawing Sheets

(56) References Cited

U.S. PATENT DOCUMENTS 2,617,188 A * 11/1952 Giorgi ..... B26B 19/20 30/201
2,618,060 A * 11/1952 Giorgi ..... B26B 19/20 30/201
2,624,113 A * 1/1953 Giorgi ..... B26B 19/20 30/201
D169,108 S * 3/1953 Sekerdy ..... D28/54
2,636,265 A * 4/1953 Sneed ..... B26B 19/00 30/233.5
2,639,503 A * 5/1953 Thurston ..... B26B 19/20 30/200
2,707,328 A * 5/1955 Witthofft ..... B26B 19/20 30/202
D175,141 S * 7/1955 Andis ..... D28/54
2,718,696 A * 9/1955 Green ..... B26B 19/20 30/200
2,722,741 A * 11/1955 McAuliffe ..... B26B 19/20 30/201
2,780,868 A * 2/1957 Brown ..... B26B 19/20 30/200
2,789,348 A * 4/1957 Clark ..... B26B 19/20 30/201
2,809,425 A * 10/1957 Tettis ..... B26B 19/20 30/233.5
2,826,812 A * 3/1958 Haislip ..... B26B 19/20 30/233.5
D185,170 S * 5/1959 Peters ..... D28/54
2,916,820 A * 12/1959 Clark ..... B26B 19/20 30/201
2,941,293 A * 6/1960 Mazzoni ..... B26B 19/20 30/201
3,041,726 A * 7/1962 Hitson ..... B26B 19/20 30/201
3,054,183 A * 9/1962 Zucker ..... B26B 19/00 30/202
3,060,573 A * 10/1962 Clark ..... B26B 19/20 30/201
3,060,574 A * 10/1962 Thomas ..... B26B 19/20 30/202
D197,367 S * 1/1964 Marrello ..... D28/54
3,149,418 A * 9/1964 Milbourne ..... B26B 19/20 30/201
3,237,304 A * 3/1966 Merzon ..... A45D 24/36 30/201
3,334,416 A * 8/1967 Green ..... B26B 19/20 30/200
3,387,367 A * 6/1968 Merzon ..... B26B 19/20 30/201
3,648,370 A * 3/1972 Cercone ..... B26B 19/20 30/201
3,969,819 A * 7/1976 Pepera ..... B26B 19/20 30/200
4,493,154 A * 1/1985 Pascual ..... B26B 19/22 30/233.5
4,542,585 A * 9/1985 Ito ..... B26B 19/06 30/210
D286,454 S * 10/1986 Stephens ..... D28/54
4,622,745 A * 11/1986 Wahl ..... B26B 19/20 30/201
4,724,614 A * 2/1988 Wahl ..... B26B 19/20 30/200
D303,299 S * 9/1989 Whitehead ..... D28/54
5,937,526 A * 8/1999 Wahl ..... B26B 19/20 30/200
6,079,103 A * 6/2000 Melton ..... B26B 19/20 30/43.92
6,243,955 B1 * 6/2001 Forbers ..... B26B 19/20 30/233.5
6,807,736 B2 * 10/2004 Langley ..... B26B 19/20 30/123
D559,456 S * 1/2008 Melton ..... D28/54
D565,793 S * 4/2008 Wallace ..... D28/54
D574,557 S * 8/2008 Kling ..... D28/54
7,536,789 B2 * 5/2009 Michel ..... A45D 24/22 30/200
7,918,029 B2 * 4/2011 Melton ..... A45D 24/36 30/200
8,136,253 B2 * 3/2012 Zoot ..... B26B 19/22 30/233.5
D658,331 S * 4/2012 Yoon ..... D28/54
8,439,190 B2 * 5/2013 Michel ..... A45D 24/22 30/233.5
8,727,409 B2 * 5/2014 McCambridge .... B26B 19/3833 294/137
8,782,905 B2 * 7/2014 Gonzales ..... B26B 19/20 30/233.5
8,844,142 B2 * 9/2014 Kammer ..... B26B 19/20 30/233.5
D722,201 S * 2/2015 Boulanger ..... D28/54
D748,862 S * 2/2016 Aulwes ..... D28/54
D791,410 S * 7/2017 Whittaker ..... D28/54
2008/0047145 A1 * 2/2008 Dietzel ..... B26B 19/20 30/34.05
2008/0295340 A1 * 12/2008 Carlucci ..... B26B 19/063 30/199
2009/0019706 A1 * 1/2009 Werner ..... B26B 19/20 30/233.5
2009/0113722 A1 * 5/2009 Werner ..... B26B 19/20 30/200
2014/0325848 A1 * 11/2014 Chen ..... B26B 13/24 30/233.5
2014/0331504 A1 * 11/2014 Michel ..... B26B 19/3813 30/233.5
2014/0352158 A1 * 12/2014 McCambridge ..... B26B 19/06 30/200

FOREIGN PATENT DOCUMENTS

EP 1493539 A1 * 1/2005 ..... B26B 19/20
JP 03082496 A * 4/1991

* cited by examiner

CLIPPER COMB HAVING A HOLDABLE EXTENSION

BACKGROUND

Electronic clippers are regularly used by many to cut hair. Some electronic clippers have the ability to be equipped with guide combs, or clipper guards, which are attachments that help ensure even hair length during hair cutting. These guide combs come in a variety of sizes and are secured to the clipper by an attachment mechanism. However, after frequent use, the attachment mechanism becomes weak and may no longer adequately secure the guide comb to the electronic clipper. This can lead to guide comb displacement during clipper use, which may produce an unwanted haircut. Therefore, it would be desirable for users if instances of guide comb displacement during electronic clipper use were limited.

BRIEF SUMMARY

In summary, one aspect provides a guide comb having a holdable extension, comprising: a central portion comprising; a plurality of teeth extending at one end thereof; and the holdable extension extending from an opposite end with respect to the plurality of teeth; wherein a lower face of the central portion includes an attachment member to reversibly secure a hair clipper.

Another aspect provides a kit, comprising: a hair clipper; a variety of guide combs having a plurality of teeth extending at one end thereof, wherein each of the variety of guide combs has different sized teeth; the variety of guide combs, further comprising: a central portion comprising; the plurality of teeth extending at one end thereof; and a holdable extension extending from an opposite end with respect to the plurality of teeth; wherein a lower face of the central portion includes an attachment member to reversibly secure the hair clipper.

A further aspect provides a method of manufacturing a guide comb having a holdable extension, comprising: producing a guide comb comprising an attachment part and a holdable extension, wherein the attachment part secures a hair clipper.

The foregoing is a summary and thus may contain simplifications, generalizations, and omissions of detail; consequently, those skilled in the art will appreciate that the summary is illustrative only and is not intended to be in any way limiting.

For a better understanding of the embodiments, together with other and further features and advantages thereof, reference is made to the following description, taken in conjunction with the accompanying drawings. The scope of the invention will be pointed out in the appended claims.

DETAILED DESCRIPTION

Figure 1A:
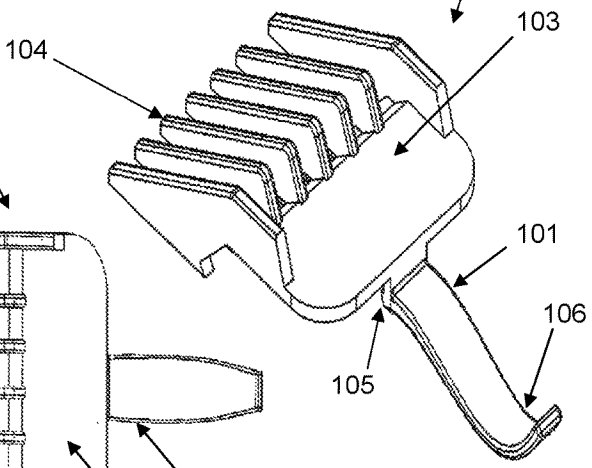
FIGS. 1(A-C) illustrate multiple views of an open-styled holdable extension in relation to a guide comb.

It will be readily understood that the components of the embodiments, as generally described and illustrated in the figures herein, may be arranged and designed in a wide variety of different configurations in addition to the described example embodiments. Thus, the following more detailed description of the example embodiments, as represented in the figures, is not intended to limit the scope of the embodiments, as claimed, but is merely representative of example embodiments.

Reference throughout this specification to "one embodiment" or "an embodiment" (or the like) means that a particular feature, structure, or characteristic described in connection with the embodiment is included in at least one embodiment. Thus, the appearance of the phrases "in one embodiment" or "in an embodiment" or the like in various places throughout this specification are not necessarily all referring to the same embodiment.

Furthermore, the described features, structures, or characteristics may be combined in any suitable manner in one or more embodiments. In the following description, numerous specific details are provided to give a thorough understanding of embodiments. One skilled in the relevant art will recognize, however, that the various embodiments can be practiced without one or more of the specific details, or with other methods, components, materials, et cetera. In other instances, well known structures, materials, or operations are not shown or described in detail to avoid obfuscation.

The emergence of electronic clippers ("clippers") has provided users the ability to cut hair more quickly. Clippers are used in a wide variety of locations such as barbershops, salons, animal grooming facilities, and by users at home. However, by themselves, most clippers are unable to precisely cut hair to specific hair lengths.

One current method to assist in precision involves the use of guide combs ("combs"), which are removable attachments that can be secured to the clipper. The combs may come in varying sizes (e.g., ranging from 1/16" to 1½"), where each size directly corresponds to a predetermined hair length. For example, a size 2 comb may cut hair to a final length of ¼" (6mm). The comb is secured onto the clipper through an attachment member, sometimes referred to as a tab, located on the comb that snaps onto the cutting blade of the clipper. After frequent instances of attachment and removal, the attachment member weakens and may no longer properly secure the comb to the clipper. In some situations, this may result in the comb falling off during the hair cutting process. Such cases may lead to an undesirable haircut because too much hair was inadvertently removed from a certain portion. Depending on the situation, these accidents may be difficult to correct. Furthermore, in the case of professional barbers and hair stylists, the production of a bad haircut may lead to a loss in clients and revenue.

These technical issues present problems for users in that limiting the frequency of comb displacement during haircuts may be difficult. A conventional solution is to manually secure the comb to the cutting blade of the clipper by holding the attachment member down with a finger, against the clipper, to prevent the comb from falling off. However, this holding orientation is inconvenient and may result in the user focusing more on preventing the comb from falling off than on producing a good quality haircut. In addition, because the user is being more cautious, they may lose speed while cutting hair. This issue is especially relevant to professional barbers and hair stylists, who deal with a high volume of daily clients.

Accordingly, an embodiment provides a method for securing a comb to a clipper while cutting hair. Using this method, the comb is prevented from falling off of the clipper due to a holdable extension that protrudes from one end of the comb that a user may grip while operating the clipper. In an embodiment, the holdable extension may be an open-style holdable extension containing a curved portion that allows a user to conveniently and effectively secure the comb to the clipper, by gripping, even if the attachment member is worn down. In another embodiment, the holdable extension may be a closed-style holdable extension containing a finger loop into which a user's finger may be inserted, which also provides comb securement and comfort of use. In an additional embodiment, the holdable extension may be fastened to a receiving portion, located on the bottom side of the clipper body, to provide, in conjunction with the attachment member, a second level of secured attachment.

The illustrated example embodiments will be best understood by reference to the figures. The following description is intended only by way of example, and simply illustrates certain example embodiments.

Figure 1B:
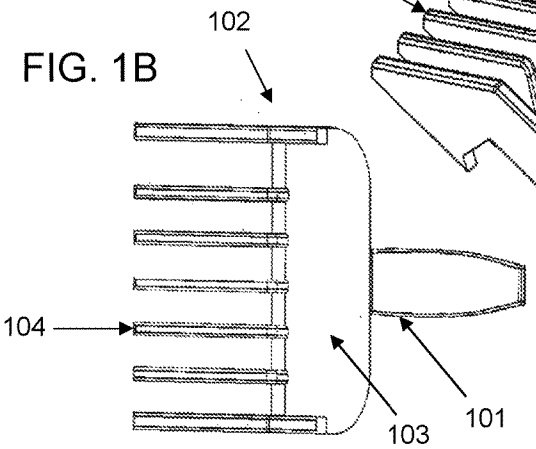
Figure 1C:
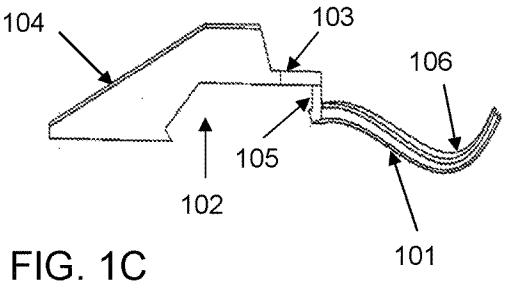

Referring to FIGS. 1(A-C), in an embodiment, the holdable extension may be an open-style holdable extension. FIGS. 1(A-C) illustrate multiple views of an open-style holdable extension 101 in relation to a guide comb 102. In an embodiment, the guide comb 102 may be comprised of a central portion 103 having a plurality of teeth 104 at one end and an attachment member 105 at the other. In an embodiment, the attachment member 105 may be located at the rear end of the bottom face of the central portion 103, opposite the plurality of teeth 104.

In an embodiment, the open-style holdable extension 101 may extend away from the central portion 103 in a direction opposite the plurality of teeth 104. In an embodiment, the open-style holdable extension 101 may be positioned adjacent to the rear end of the central portion 103 at any location along the vertical length of the attachment member 105. In another embodiment, the open-style holdable extension 101 may be positioned adjacent to the rear end of the central portion 103 at any horizontal location of the rear end of the central portion 103 not considered to be part of the attachment member 105. In a further embodiment, the open-style holdable extension 101 may be attached to the lower face of the central portion 103 of the guide comb 102.

Figure 2:
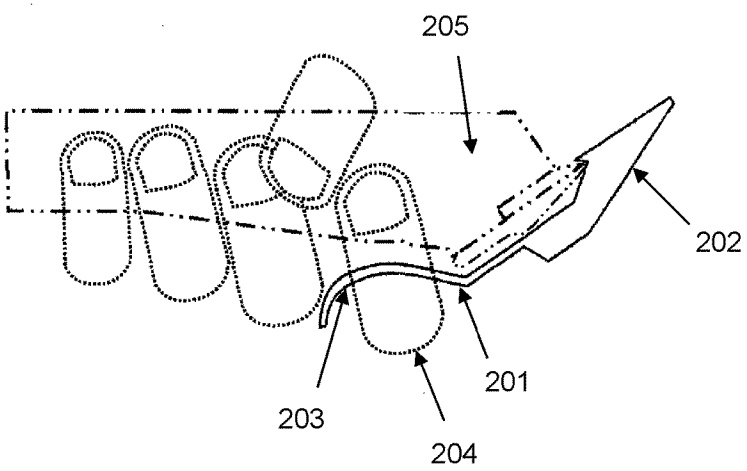
FIG. 2 illustrates an example holding orientation while using an open-styled holdable extension.

In an embodiment, the open-style holdable extension 101 may include a curved portion 106. The curved portion 106 allows for ergonomic finger grip and support. As illustrated in FIG. 2, a user may comfortably position their finger 204 in the curved portion 203 of the open-style holdable extension 201 to secure the guide comb 202 against the body of the clipper 205. In an embodiment, the open-style holdable extension 201 may be comprised of a flexible material, such as plastic, to allow it to be easily gripped against the body of the clipper 205. In an embodiment, a user may grip the open-style holdable extension 201 with at least one finger 204 against the body of the clipper 205. In another embodiment, a user may grip the open-style holdable extension 201 with more than one finger 204 to provide increased security.

In an embodiment, the length and width of the open-style holdable extension 101 may vary based on the type of guide comb 102 used. For example, the dimensions of an open-style holdable extension 101 for a beard trimming comb may be different than the dimensions of an open-style holdable extension 101 for a traditional hair trimming comb because the two combs have different proportions. In an embodiment, the length of the open-style holdable extension 101, measuring from the point being adjacent to the central portion 103 to the terminal end of the curved portion 106, may be at least, but may also be longer than, one inch.

Figure 4:
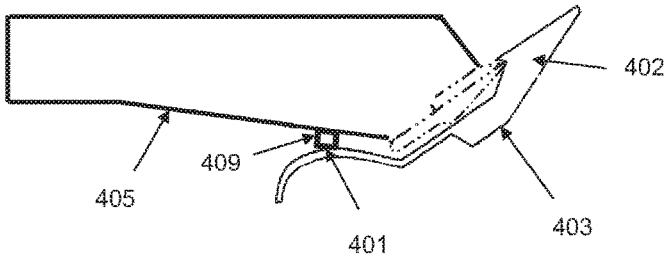
FIG. 4 illustrates a generic receiving portion of a hair clipper.

In an embodiment, a point along the terminal end of the open-styled holdable extension 401, opposite from the central portion 403 of the guide comb 402, may be fastened to a receiving portion 409 located on the bottom of the clipper body 405. This would secure the open-style holdable extension 401 in place and provide another level of secured attachment, further diminishing the chance that the guide comb 402 would fall off the clipper blade. FIG. 4 illustrates a generic illustration of a receiving portion 409.

Figure 3A:
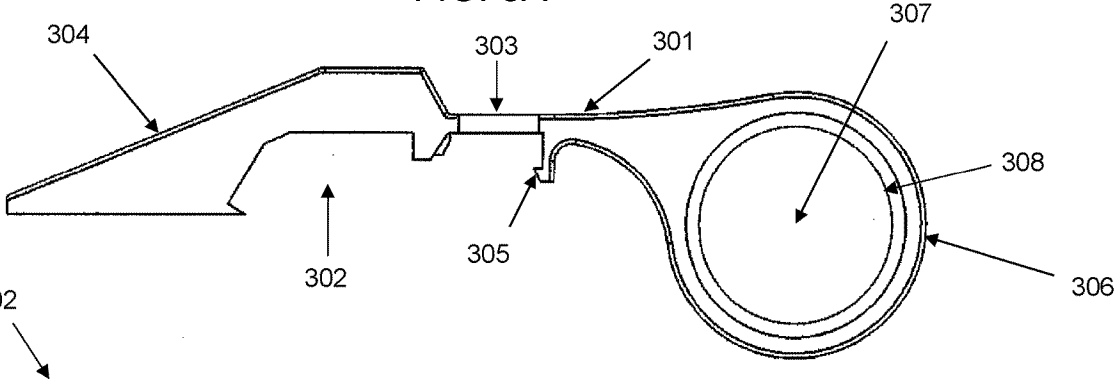
FIGS. 3(A-C) illustrate multiple views of a closed-styled holdable extension in relation to a guide comb.
Figure 3C:
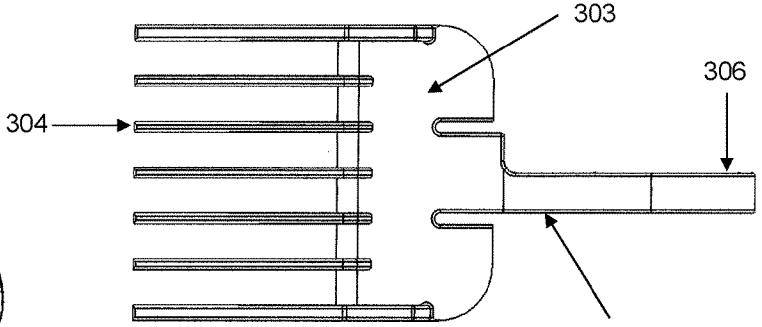
Figure 3B:
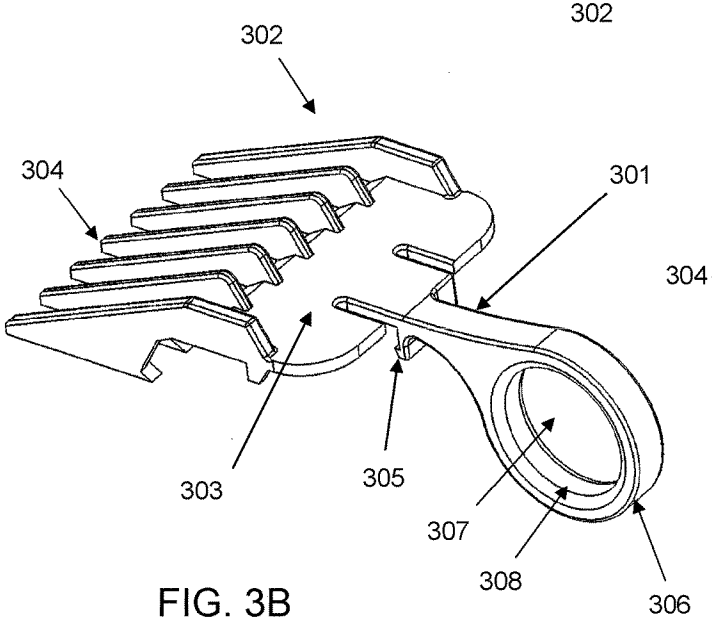

Referring now to FIGS. 3(A-C), in an embodiment, the holdable extension may be a closed-style holdable extension. FIGS. 3(A-C) illustrate multiple views of the closed-style holdable extension 301 in relation to a guide comb 302. In an embodiment, the guide comb 302 may be comprised of a central portion 303 having a plurality of teeth 304 at one end and an attachment member 305 at the other. In an embodiment, the attachment member 305 may be located at the rear end of the bottom face of the central portion 303, opposite the plurality of teeth 304.

In an embodiment, the closed-styled holdable extension 301 may extend away from the central portion 303 in a direction opposite the plurality of teeth 304. In an embodiment, the closed-style holdable extension 301 may be positioned adjacent to the rear end of the central portion 303 at any location along the vertical length of the attachment member 305. In another embodiment, the closed-style holdable extension 301 may be positioned adjacent to the rear end of the central portion 303 at any horizontal location of the rear end of the central portion 303 not considered to be part of the attachment member 305. In a further embodiment, the closed-style holdable extension 301 may be attached to the lower face of the central portion 303 of the guide comb 302.

In an embodiment, the closed-style holdable extension 301 may contain a finger loop 306. In an embodiment, the finger loop 306 may be located at the terminal end of the closed-style holdable extension 301, opposite from the central portion 303 of the guide comb 302. The finger loop 306 allows a user to place at least one finger inside of the enclosed space 307 and may provide a user with a greater sense of stability and control while they cut hair.

In an embodiment, the finger loop 306 may contain padding surrounding some, or all, of the inside of the enclosure 308 in order to make the closed-style holdable extension 301 more comfortable to hold. In an embodiment, the finger loop 306 may be circular. In another embodiment, the finger loop 306 may be any shape and size that allows a user to comfortably insert at least one finger through the enclosed space 307 of the finger loop 306. For example, in an embodiment, the finger loop 306 may be circular and the diameter of the enclosed space 307 may be one inch. In an embodiment, the closed-style holdable extension 301 may be comprised of a flexible material, such as plastic, to allow it to be easily gripped against the body of the clipper 205.

In an embodiment, the length and width of the closed-style holdable extension 301 may vary based on the type of guide comb 302 used. In an embodiment, the length of the closed-style holdable extension 301, measuring from the point being adjacent to the central portion 303 to the terminal end of the finger loop 306, may be at least, but may also be longer than, one inch.

The various embodiments described herein thus represent a technical improvement to conventional clipper-based haircutting techniques. Using the techniques and products described herein, a user can cut hair using an electronic clipper having a guide comb without worrying that the guide comb will fall off during the haircut. Rather than holding onto the attachment portion of the guide comb, the user is able to comfortably hold on to a holdable extension protruding from the guide comb.

As used herein, the singular "a" and "an" may be construed as including the plural "one or more" unless clearly indicated otherwise.

This disclosure has been presented for purposes of illustration and description but is not intended to be exhaustive or limiting. Many modifications and variations will be apparent to those of ordinary skill in the art. The example embodiments were chosen and described in order to explain principles and practical application, and to enable others of ordinary skill in the art to understand the disclosure for various embodiments with various modifications as are suited to the particular use contemplated.

Thus, although illustrative example embodiments have been described herein with reference to the accompanying figures, it is to be understood that this description is not limiting and that various other changes and modifications may be affected therein by one skilled in the art without departing from the scope or spirit of the disclosure.

What is claimed is:

1. A hair clipper, comprising:

a clipper grip body with a rear edge and at least one blade with outer side and an inner side connected to the grip body;

a guide comb comprising a central portion, an attachment member positioned on a lower face of the central portion, a plurality of teeth extending from one end of the central portion, a holdable extension engaging the attachment member, the holdable extension having a support portion; and wherein the guide comb is attached to the outer side of the at least one blade via the attachment member and the holdable extension member extends from an opposite end of the central portion with respect to the teeth to a location beyond the inner side of the at least one blade and along the rear edge of the grip body so that when a user grasps the grip body of the clippers, a finger of the user is received by the support portion of the holdable extension.

2. The hair clipper of claim 1, wherein the holdable extension is at least one inch long.

3. The hair clipper of claim 1, wherein the holdable extension is flexible.

4. The hair clipper of claim 1, wherein the holdable extension is composed of plastic.

5. The hair clipper of claim 1, wherein the holdable extension extends from the attachment member.

6. The hair clipper of claim 1, wherein the support portion comprises a curved portion.

7. The hair clipper of claim 1, wherein the holdable extension is attachable to a receiving portion located on the hair clipper.

8. The hair clipper of claim 1, wherein the support portion comprises a finger loop.

9. The hair clipper of claim 8, wherein the finger loop contains padding surrounding an inner portion of the finger loop.

10. A kit, comprising:

a hair clipper with a clipper grip body with a rear edge and at least one blade with outer side and an inner side connected to the grip body;

a variety of guide combs, each of the combs comprising a central portion, an attachment member positioned on a lower face of the central portion, a plurality of teeth extending from one end of the central portion, a holdable extension engaging the attachment member, the holdable extension comprising a support portion; and when a respective one of the combs is to be used with the clippers, the guide comb is attached to the outer side of the at least one blade via the attachment member and the holdable extension member extends from an opposite end of the central portion with respect to the teeth to a location beyond the inner side of the at least one blade and along the rear edge of the grip body so that when a user grasps the grip body of the clippers, a finger of the user is received by the support portion of the holdable extension.

11. The kit of claim 2, wherein at least one of the holdable extensions is flexible.

12. The kit of claim 2, wherein at least one of the holdable extensions is composed of plastic.

13. The kit of claim 2, wherein at least one of the holdable extensions extend from a respective one of the attachment members.

14. The kit of claim 2, wherein at least one of the support portions comprise a curved portion.

15. The kit of claim 2, wherein at least one of the holdable extensions is attachable to a receiving portion located on the hair clipper.

16. The kit of claim 2, wherein at least one of the support portions comprise a finger loop.

17. The kit of claim 16, wherein the finger loop contains padding surrounding an inner portion of the finger loop.

18. A Method of attaching a guide comb comprising a central portion, an attachment member positioned on a lower face of the central portion, a plurality of teeth extending from one end of the central portion, a holdable extension engaging the attachment member, the holdable extension has a support portion to hair clippers comprising a clipper grip body with a rear edge and at least one blade with outer side and an inner side connected to the grip body, the method comprising:

attaching the guide comb to the outer side of the at least one blade via the attachment member where the holdable extension member extends from an opposite end of the central portion with respect to the teeth to a location beyond the inner side of the at least one blade and along the rear edge of the grip body so that when a user grasps the grip body of the clippers, a finger of the user is received by the support portion of the holdable extension.

* * * * *